United States Patent [19]

Bitler

[11] 4,236,501

[45] Dec. 2, 1980

[54] DUAL ACTION SAFETY LATCH FOR STOVE DOOR

[75] Inventor: Harold C. Bitler, Springfield, Oreg.

[73] Assignee: Fisher Stove Works, Eugene, Oreg.

[21] Appl. No.: 17,464

[22] Filed: Mar. 5, 1979

[51] Int. Cl.[3] ..... F24C 15/04; E05C 3/04; E05C 3/02

[52] U.S. Cl. ..... 126/197; 292/238; 292/340

[58] Field of Search ..... 126/197, 218, 192, 62, 126/193, 190, 77, 290, 287, 66, 65; 292/238, 241, 230, 340, 202, 204, 194

[56] References Cited

U.S. PATENT DOCUMENTS

| | | | |
|---|---|---|---|
| 1,945,156 | 1/1934 | Moore | 292/241 |
| 2,094,547 | 9/1937 | McCulloch | 292/202 |
| 2,955,859 | 10/1960 | Krause | 292/6 |
| 4,157,704 | 6/1979 | Zimmer | 126/197 |

*Primary Examiner*—Samuel Scott
*Assistant Examiner*—J. Anderson
*Attorney, Agent, or Firm*—Chernoff & Vilhauer

[57] ABSTRACT

A latch for a door of a substantially airtight solid-fuel stove, whose operation requires that before full opening of the stove door can be accomplished the door be positioned in a partially opened position while the latch is being manipulated. A latch dog normally engages a wedge to hold the door fully closed, and a limit stop allows a first rotation of the latch mechanism to disengage the dog from the wedge but prevents rotation sufficient to allow the latch dog to clear the edge of the doorway opening. A space defined between the wedge and the front of the stove permits the latch dog to pass between the wedge and the front of the stove during a second rotation of the latch mechanism, in the opposite direction, to a position allowing full opening of the stove door. During this second motion of the latch mechanism the door is partially opened, allowing sufficient air to enter the combustion chamber to establish normal convective draft currents and prevent backpuffing and expulsion of smoke and flame.

9 Claims, 6 Drawing Figures

FIG. 2
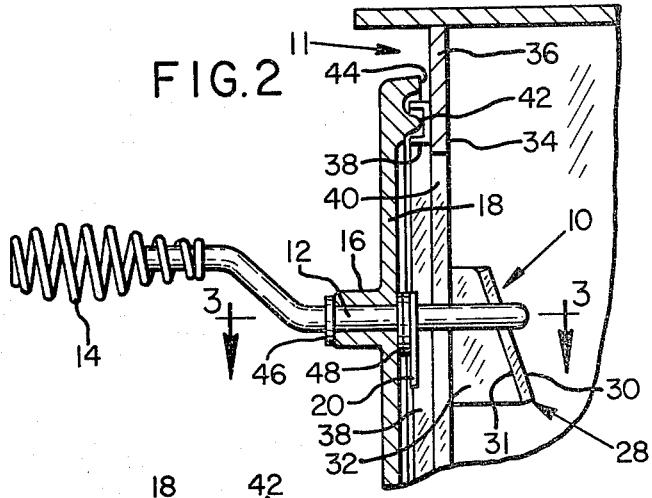
FIG. 3
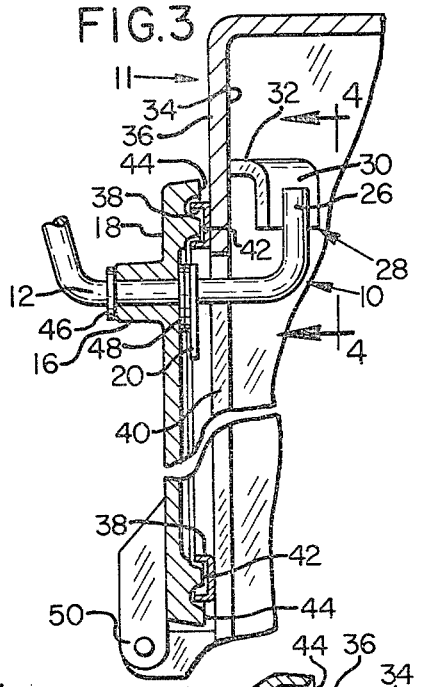
FIG. 4
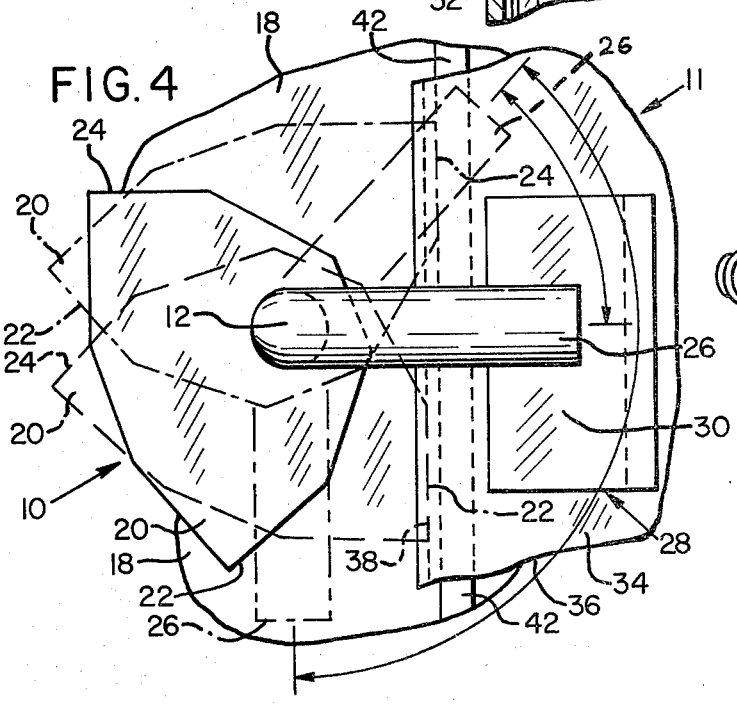
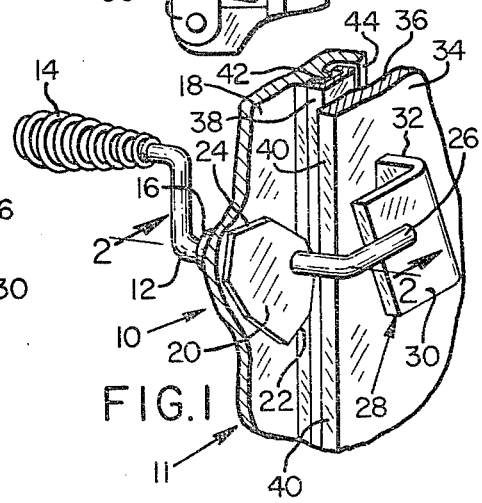
FIG. 1
FIG. 5
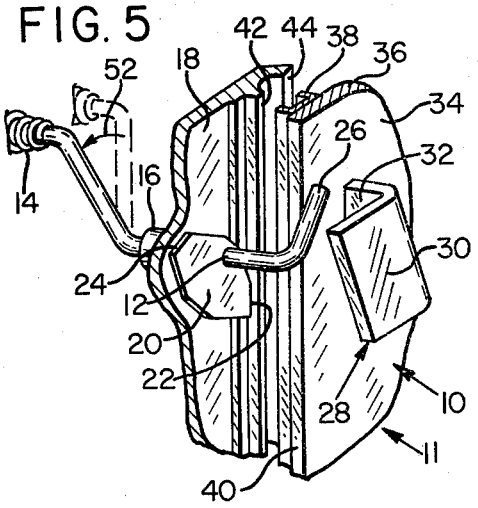
FIG. 6
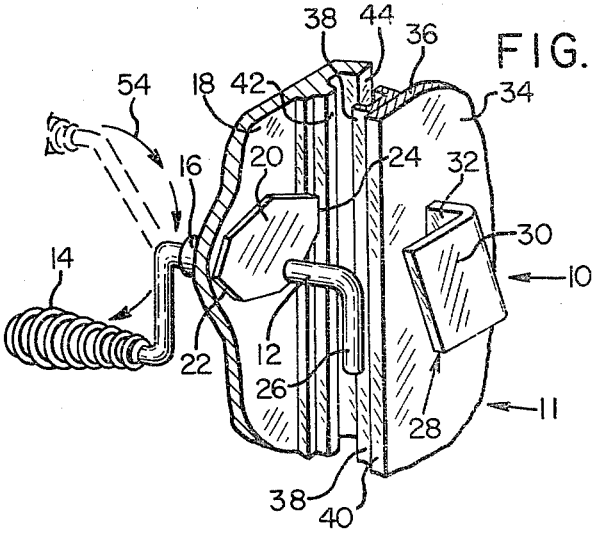

DUAL ACTION SAFETY LATCH FOR STOVE DOOR

BACKGROUND OF THE INVENTION

The present invention relates to improvements in solid-fuel burning stoves, and particularly to an improved latch for a door to the combustion chamber of such a stove.

Stoves which burn wood, coal, or similar solid fuels have long been used for cooking and for heating dwellings. Because of continually increasing costs for fuel, numerous efforts have been made to improve the efficiency of fuel use in these stoves. The pot-bellied stove once common in the parlor drew its combustion air from the room in which the stove was located. A damper, located usually in the stove pipe leading to the chimney flue, and an air inlet register, usually located in the stove front, provided some control of the amount of air admitted to the combustion chamber of the stove, but the stove was far from airtight, and a large volume of already heated air from the space surrounding the stove was drawn into the stove and used to burn the fuel. Thus, this heated room air was exhausted up the chimney and was lost.

Recently developed heating stoves use a substantially airtight combustion chamber and efficient air supply control dampers to overcome the aforementioned shortcoming of these stoves by limiting the amount of combustion air admitted to the fire to a small portion of that which would have been drawn into non-airtight stoves. The result of this construction is that combustion of fuel within the stove is limited by the amount of oxygen contained in the restricted supply of air admitted to the combustion chamber. The temperature of fuel within such a stove often far exceeds the ignition temperature of the fuel, but when the air supply control damper of the stove restricts the air supply, the fuel can burn only at a reduced rate. This provides better control over utilization of the fuel, since a smaller proportion of the heat liberated by combustion of the fuel is allowed to escape through the chimney, allowing more of the heat produced by combustion of the fuel to be conducted through the stove and radiated into the rooms being heated by the stove than is possible with non-airtight stoves.

While improving economy, this provision does have associated significant problems. A door to the combustion chamber is still necessary to allow placement of fuel in the combustion chamber, and when the door is opened, unless it is moved very slowly, a low pressure zone is created behind the door which may pull smoke and flame outward from the stove into the room.

Another related problem, particularly if the stove contains fuel whose temperature is above its ignition point but which has previously been prevented from burning because of air starvation, is that free admission of oxygen to the combustion chamber when the stove door is opened may result in nearly explosive ignition of the flammable gaseous portions of the fuel present within the combustion chamber. This extremely rapid ignition, known as backpuffing, presents a risk of burn injury of the person opening the stove door as the burning gases rapidly expand.

A partial solution to this problem is to always allow air to freely enter the combustion chamber by opening the air supply register before opening the door. However, this procedure entails an additional step which the user must remember each time the door is opened. A better solution is to eliminate the possibility of opening the stove door too rapidly by providing a latch which necessitates a two step door opening procedure. If the door is first opened a small distance so that air is allowed to enter the combustion chamber for a short time, this additional combustion air which is allowed to enter the firebox does so gradually enough to burn the fuel without an explosive effect. The flame, smoke, and other gaseous products of combustion are then able to re-establish or follow the normal convective pattern and be exhausted through the stove pipe and chimney flue. This procedure particularly eliminates the possibility of flame or smoke being sucked or explosively forced into the room in which the stove is located.

In the past, however, no means of requiring this procedure has been provided in stoves. Stoves have been equipped typically with simple latches which hold the doors in their normal closed positions. When released, such latches simply allow the doors to be opened fully, but make no requirement for hesitation with the door slightly ajar.

Jennings, Jr., U.S. Pat. No. 2,970,718 discloses a latch for a door of a sterilizer which may have an interior pressure greater than atmospheric pressure. The latch disclosed by Jennings prevents opening of the sterilizer door so long as the pressure within the sterilizer is above atmospheric pressure, by requiring the door to be pressed inwardly against the pressure in the sterilizer to allow a shoulder in one portion of the latch to clear the top of a keeper before the latch may be further rotated to completely release the door. While this latch provides a two step door opening procedure the first step does not provide movement of the door away from the mating surfce of the doorway to allow admission of air. Thus use of this type of latch on a door of a solid-fuel stove would not serve the desired function.

What is required, therefore, is a latch for a combustion chamber door of a solid-fuel stove which requires the door to hesitate in a partially position before it may be fully opened.

SUMMARY OF THE INVENTION

The aforementioned likelihood of withdrawing smoke and flame, or of the occurrence of backpuffing, upon opening the combustion chamber door of previously known stoves is overcome by the present invention, which provides a novel stove door latch which requires the combustion chamber door to be placed in a partially opened position for a short time before it can be fully opened.

The latch of the invention has a catch or dog extending perpendicularly from an end of a shaft which preferably is mounted so that it extends through the door of the stove. The dog is movable by rotation of the shaft to engage with or disengage from a wedge surface which is inclined with respect to the plane of rotation of the dog. The wedge is connected to the interior of the stove structure in a position spaced a predetermined distance away from the inner surface of the wall of the stove. Sufficient space for passage of the dog is thus defined between the back of the wedge and the interior surface of the stove. A limit plate is also mounted on the latch shaft, in alignment with the edge of the doorway opening of the stove. Two limiting surfaces on the edge of the limit plate require rotation of the latch shaft in two separate and opposite motions before the door may be opened. A first rotation limit stop allows a first rotation in which the latch dog may be moved far enough to be disengaged from the wedge, but not far enough to move past the edge of the doorway of the stove. Once the dog has been moved clear of the wedge the stove door may be opened by a distance equivalent to the spacing between the wedge surface and the inner surface of the stove, a distance preferably of about one inch. This partial opening of the door allows a moderate amount of air to enter the combustion chamber of the stove at a rate which permits safe combustion of volatilized wood hydrocarbons and the like, that is, without a near-explosion and without projecting flames through the doorway.

The stove door cannot be fully opened, however, without a second rotation of the latch shaft in the opposite direction. After the latch dog has been moved clear of engagement with the wedge, it still prevents full opening of the door by engaging the inner surface of the stove front adjacent the doorway opening. The door must be opened partially to allow the dog to pass between the back of the wedge and the inner surface of the stove casing, giving a brief period of time in which air may enter the firebox and generate the normal convective flow of combustion products away from the firebox through the normal smoke conduit and chimney flue route. Only after this brief hesitation in a partly open position may the door be opened fully.

It is therefore a major objective of the present invention to provide an improved latch mechanism for the fuel-loading doors of solid-fuel domestic heating stoves and the like.

It is a further objective of the invention to provide a latch mechanism which prevents too rapidly opening the fuel-admission doors of domestic heating stoves.

It is another objective of the present invention to accomplish the above stated objectives by use of an inexpensive yet positively operating latch mechanism.

It is a feature of the latch mechanism of the present invention that it positively requires a fuel-admission door of a solid-fuel heating stove to be opened partially and to remain in such a partially opened position for a short period of time before the door may be fully opened.

The foregoing and other objectives, features, and advantages of the invention will be more readily understood upon consideration of the following detailed description of the invention, taken in conjunction with the accompanying drawings.

BRIEF DESCRIPTION OF THE DRAWINGS

FIG. 1 is a perspective view of an exemplary latch mechanism embodying the present invention, as seen from inside a stove in which the latch machanism is installed, with the stove door latched shut.

FIG. 2 is a sectional side elevational view of the latch mechanism of FIG. 1, taken along line 2—2.

FIG. 3 is a top view of the latch mechanism, taken along line 3—3 of FIG. 2.

FIG. 4 is rear elevational view of the latch mechanism taken along line 4—4 of FIG. 3, showing the range of rotation of the latch shaft permitted by the limit plate.

FIG. 5 is a perspective view of the latch mechanism with the stove door in the partially opened position required during operation.

FIG. 6 is a perspective view of the latch mechanism with the latch dog in the position allowing the stove door to be fully opened.

DETAILED DESCRIPTION OF THE PREFERRED EMBODIMENT

Referring now to the drawings, in FIG. 1 an exemplary latch mechanism 10 embodying the invention is shown installed in a stove 11. A latch operating shaft 12 includes a handle 14, of suitable heat dispersing or insulating construction, attached to an offset section at one end of the shaft. The other end of the shaft extends through a boss 16 in a stove door 18, allowing the shaft to be rotated by movement of the handle. A limit plate 20 having a first rotation limit stop 22 which comprises one edge surface of the limit plate, and a second rotation limit stop 24, which comprises a second edge surface of the limit plate, is fixedly attached to the shaft, as by welding, adjacent the interior side of the door 18, and a latch dog 26, formed preferably by bending a portion of the latch shaft 12 at a right angle, is spaced from the limit plate a short distance farther from the door. The rotational movement of the dog 26 on the shaft relative to the limit plate is critical, as will be explained below.

In FIG. 1 the latch is shown in the closed position, with the latch dog 26 in positive engagement with a wedge 28, which comprises a front, or camming surface 30, along which the latch dog may slide when the latch is rotated thereby pulling the door 18 tightly shut. The wedge 28 is supported by a spacer bracket 32 which holds the wedge spaced apart from the inner surface 34 of a stove front member 36. For economy in manufacture the wedge and spacer bracket are formed of a single piece of metal plate which is attached preferably by welding to the inner surface 34. A washer 46, in FIG. 2, is attached suitably, as by welding, to the latch shaft 12 on the exterior side of the door 18 and acts as a thrust bearing to hold the door closed when the latch dog engages the camming surface 30. A suitable number of washers 48 may also be used to provide a desired spacing between the door 18 and the limit plate 20. The door 18 is pivotally attached to the front member 36 of the stove by a hinge 50 located on the opposite side of the door 18 from the latch mechanism 10, as shown in FIG. 3. Thus the latch mechanism handle 14 may be used to swing the door open or shut.

Referring now also to FIG. 2, the stove 11 may be seen to comprise a channel 38, of U-shaped cross-section, attached, preferably by welding, to the front member 36. The channel 38 extends around the periphery of a doorway opening defined by an edge 40. An inner lip 42 and an outer lip 44 located peripherally around the door 18 extend toward the stove front member 36, and intermesh with the channel 38 to form a substantially airtight seal when the door of the stove is tightly closed. Suitable packing material may be mounted within the channel if required to provide a tight seal.

Referring now to FIG. 4, it may be seen that the limit plate 20 places certain restrictions on the rotation of the latch shaft 12. In the fully closed position shown in solid line, the latch dog engages the camming surface 30 of the wedge 28, and the limit plate is in a central position in which neither limit stop is in contact with any other portion of the stove.

In a first rotated position, shown in broken line, the latch is rotated so that the latch dog 26 is in a position clear of the wedge 28, and the first rotation limit stop 22 is in contact with either the channel 38 or the inner lip 42, depending on whether the door has been partially opened or not. Thus the limit plate prevents further rotation of the latch in that same direction, holding the latch dog in a position in which it overlaps the stove front 36 and acts as a retention device preventing full opening of the door 18 but permitting it to be moved to a partially open position.

In a second rotated position of the latch mechanism, shown in phantom line in FIG. 4, the latch dog 26 is in a downwardly extending vertical position, and the second rotation limit stop 24 is in contact with the edge of the inner lip 42.

Referring now also to FIGS. 5 and 6, the operation of the dual-action safety latch of the invention may be more clearly understood. Referring first to FIG. 5, it may be seen that in opening the door the latch is first rotated in the direction indicated by arrow 52 to the first rotated position. In this position the latch dog 18 is disengaged from the wedge 28, and the door can be partially opened to a position wherein the latch dog engages the inner surface 34 of the stove front 36. At this point the first rotation limit stop 22 abuts the inner lip 42 of the door and prevents further rotation of the latch in the direction indicated by the arrow 52. However, the separation between the back surface 31 of the wedge 28 and the inner surface 34 of the stove front is sufficient to now permit rotation of the latch mechanism in the opposite direction, indicated by arrow 54 in FIG. 6, to the second rotated position, with the latch dog passing between the wedge and the inner surface 44. Upon this rotation of the latch mechanism to the position shown in solid line in FIG. 6, the second rotation limit stop 24 is brought into abutment with the inner lip 42 of the door, preventing further rotation of the latch mechanism once the latch dog 26 has reached a downwardly pointing vertical position wherein the dog will pass by the edge 40 of the doorway opening to allow full opening of the door 18.

The time required for the above-described operation of the latch mechanism is sufficient to allow air to pass between the door 18 and the stove front 36, entering the combustion chamber of the stove while the door is in the partially opened position required for passage of the latch dog 26 behind the wedge 28. Sufficient air is thereby admitted to the combustion chamber of the stove to cause superheated fuel contained therein to burn more rapidly. Heated products of combustion may then establish the normal convective draft pattern, drawing smoke and flame out of the combustion chamber by way of the normal smoke conduit, stovepipe, and chimney flue. This avoids expulsion of smoke and flame by rapid expansion into the room in which the heating stove is situated, as might occur should the stove door be suddenly opened, allowing a large amount of oxygen to reach superheated fuel too suddenly. Of course, with the latch mechanism in the second rotated position the door 18 may be opened or it may be closed fully, should full closure be desired. Securing the door in the latched position is the reverse of the procedure for opening. While, with the latch mechanism construction shown, the door might be inadvertently closed by the user during the second motion rotation of the latch mechanism, this is unlikely to occur during opening of the door, and may in fact be prevented by forming the wedge 28 such that its back surface 31 is parallel to the inner surface 34 of the stove front member 36.

It will be obvious to the reader that the latch mechanism might also be reversed, having the wedge mounted spaced outwardly from the door of a stove, and the latch shaft rotatably connected to the stove front, without varying from the spirit of the invention.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A latch mechanism for a solid-fuel burning stove and the like having a door movable between a closed position where it closes a doorway opening to the interior of said stove and an open position away from said doorway opening, said latch comprising:

(a) dog means for releasably holding said door in said closed position;

(b) limit means associated with said dog means for requiring a first movement and a distinct second movement of said dog means before said door can be fully moved to said open position, said second movement being possible only upon movement of said door to a partially opened position intermediate said open and closed positions; and (c) retention means cooperating with said dog means for limiting movement of said door upon said first movement of said dog means to said partially opened position, said partially opened position admitting combustion-supporting air into said interior of said stove.

2. The latch mechanism of claim 1 wherein said dog means comprises a wedge fixedly mounted within said stove adjacent to said doorway, a latch dog fixedly attached to a shaft rotatably mounted in said door, means for preventing axial motion of said shaft with respect to said door, and means for rotating said shaft to move said latch dog between a position of engagement against said wedge for holding said door closed, and positions of disengagement from said wedge.

3. The latch mechanism of claim 2 wherein said retention means comprises means for engaging said latch dog when said latch dog is in a position of disengagement from said wedge and said door is in said partially opened position.

4. The latch mechanism of claim 2 wherein said stove has an interior surface adjacent to said doorway opening and said wedge is fixedly located spaced apart from said surface, said wedge and said surface defining a space permitting passage of said latch dog between said wedge and said surface during said second movement.

5. The latch mechanism of claim 2 wherein said limit means comprises first rotation limit stop means and corresponding first abutment means for cooperatively limiting the rotation of said shaft in a direction disengaging said dog from said wedge, such that said first rotation limit stop means engages said first abutment means at a predetermined rotational position of said shaft wherein said retention means limits movement of said door, and second rotation limit stop means and corresponding second abutment means for cooperatively limiting the rotation of said shaft such that when said second rotation limit stop means engages said second abutment means said door may be opened fully.

6. The latch mechanism of claim 5 wherein said first rotation limit stop means and said second rotation limit stop means are included in a limit plate fixedly connected to said shaft for rotation therewith, and said first and second abutment means are included in said door.

7. The latch mechanism of claim 1 wherein said first movement and said second movement of said dog means are in opposite directions.

8. The latch mechanism of claim 1 wherein said dog means comprises a latch dog mounted on a portion of said stove and a wedge mounted on said door, wherein said latch dog may be moved between a position of engagement with said wedge to hold said door closed, and a position of disengagement from said wedge.

9. The latch mechanism of claim 1 wherein said partially opened position of said door provides a maximum gap of about one inch between said door and said stove.

* * * * *

UNITED STATES PATENT AND TRADEMARK OFFICE

CERTIFICATE OF CORRECTION

PATENT NO. : 4,236,501

DATED : December 2, 1980

INVENTOR(S) : Harold C. Bitler

It is certified that error appears in the above-identified patent and that said Letters Patent are hereby corrected as shown below:

Col. 2, line 41, after "partially" insert --opened--.

Signed and Sealed this

*Seventeenth* Day of *November 1981*

[SEAL]

*Attest:*

GERALD J. MOSSINGHOFF

*Attesting Officer* *Commissioner of Patents and Trademarks*